US007118329B2

(12) United States Patent
Goodman

(10) Patent No.: US 7,118,329 B2
(45) Date of Patent: Oct. 10, 2006

(54) TIP SEALING FOR A TURBINE ROTOR BLADE

(75) Inventor: Peter Jeffrey Goodman, Bristol (GB)

(73) Assignee: Rolls-Royce PLC, London (GB)

( * ) Notice: Subject to any disclaimer, the term of this patent is extended or adjusted under 35 U.S.C. 154(b) by 150 days.

(21) Appl. No.: 10/989,405

(22) Filed: Nov. 17, 2004

(65) Prior Publication Data

US 2005/0220627 A1 Oct. 6, 2005

(30) Foreign Application Priority Data

Dec. 11, 2003 (GB) ..... 328679.6

(51) Int. Cl.
*F01D 5/20* (2006.01)

(52) U.S. Cl. ..... 415/173.1; 416/195; 416/235

(58) Field of Classification Search ..... 415/173.1, 415/173.5, 92, 189, 191, 192, 195, 196 R, 415/235; 416/92, 189, 191, 192, 195, 196 R, 416/235

See application file for complete search history.

(56) References Cited

U.S. PATENT DOCUMENTS 6,142,739 A * 11/2000 Harvey ..... 416/235
2002/0197160 A1 12/2002 Liang

FOREIGN PATENT DOCUMENTS

| | | |
|---|---|---|
| EP | 0 801 209 A3 | 7/1999 |
| GB | 1107024 | 3/1968 |
| GB | 1195012 | 6/1970 |
| GB | 1426049 A | 2/1976 |
| GB | 2 075 129 A | 11/1981 |
| GB | 2 322 167 A | 8/1998 |

* cited by examiner

*Primary Examiner*—Edward K. Look
*Assistant Examiner*—Dwayne J White
(74) *Attorney, Agent, or Firm*—Oliff & Berridge, PLC

(57) ABSTRACT

An unshrouded rotor blade 24 comprising an aerofoil 28, said aerofoil 28 having a leading edge 34, a trailing edge 36, a pressure surface 30 and a suction surface 32, there being provided at a radially outer extremity of the aerofoil 28 a gutter 40 which is wider than the aerofoil 28 adjacent the trailing edge 36 thereof, wherein at least a part of the gutter 40 is offset towards the aerofoil pressure surface 30.

11 Claims, 3 Drawing Sheets

TIP SEALING FOR A TURBINE ROTOR BLADE

This invention relates to turbine rotor blades and in particular to rotor blades for use in gas turbine engines.

The turbine of a gas turbine engine depends for its operation on the transfer of energy between the combustion gases and turbine. The losses which prevent the turbine from being totally efficient are due at least in part to gas leakage over the turbine blade tips.

Hence the efficiency of each rotor stage in a gas turbine engine is dependent on the amount of energy transmitted into the rotor stage and this is limited particularly in unshrouded bladed by any leakage flow of working fluid i.e. air or gas across the tips of the blades of the rotors.

In turbines with unshrouded turbine rotor blades a portion of the working fluid flowing through the turbine tends to migrate from the concave pressure surface to the convex suction surface of the aerofoil portion of the blade through the gap between the tip of the aerofoil and the stationary shroud or casing. This leakage occurs because of a pressure difference which exists between the pressure and suction sides of the aerofoil. The leakage flow also causes flow disturbances to be set up over a large proportion of the height of the aerofoil which leads to losses in efficiency of the turbine.

By controlling the leakage flow of air or gas across the tips of the blades it is possible to increase the efficiency of each rotor stage.

There is disclosed in EP 0801209 B1 an unshrouded rotor blade which has an aerofoil portion with an outer extremity having a passage defined by the peripheral wall of a gutter. This gutter allows air to flow along the full length of the rotor blade, thereby enhancing cooling of the trailing corner of the blade, an area which is normally difficult to cool.

Furthermore, the gutter is wider than the blade, extending symmetrically from the blade centreline.

The above arrangement provides the advantages that the "over tip leakage" that is the flow of hot air or gas which flows over the tip of a shroudless blade, is directed into a passage formed within the tip of the aerofoil section of the blade thereby alleviating the flow disturbances set up by this "leakage flow". Also the flow is redirected by the passage to flow from the leading edge of the aerofoil to the trailing edge through the passage and exhaust through an exit within the wall at the trailing edge. Since the flow is redirected in this way, work which would have otherwise been lost by the flow is recovered.

In addition the gutter may also contain and therefore redirect the existing classical secondary flow "passage" vortex formed from boundary layer flow which rolls up on the casing. If the gutter and the exit aperture are of a sufficient size this "passage" vortex will enter the gutter over its suction side wall and join the overtip leakage vortex, exiting through the exit aperture. This passage vortex is greatly reduced in the gutter where it is inhibited from growing freely, thus flow conditions downstream of the gutter are improved since the existing vortex is much smaller than it would otherwise have been external of the gutter. Preferably the wall portion is in the form of a gutter placed over the tip of the aerofoil section of the rotor blade.

One disadvantage of the above arrangement is that the gutter adds material, and thus weight, to the most sensitive part of the turbine blade, the blade tip. This raises stress during operation. Furthermore, where the blade is cast, the 'flared' gutter complicates the casting process, increasing defects and raising cost.

It is an aim of the present invention to provide a turbine blade which offers the performance advantages of the prior art but which alleviates the inherent disadvantages thereof. In particular the present invention has a more efficient design of gutter adjacent the blade tip which reduces the amount of additional material required in this region Accordingly the present invention provides an unshrouded rotor blade comprising an aerofoil, said aerofoil having a leading edge, a trailing edge, a pressure surface and a suction surface, there being provided at a radially outer extremity of the aerofoil a gutter which is wider than the aerofoil adjacent the trailing edge thereof, wherein at least a part of the gutter is offset towards the aerofoil pressure surface.

According to a further embodiment of the present invention, the gutter predominantly overhangs the aerofoil pressure surface.

According to a still further embodiment of the present invention, the gutter overhangs only the aerofoil pressure surface.

Preferably, the gutter overhangs the aerofoil pressure surface adjacent the aerofoil trailing edge.

Preferably, the gutter is between 1 and 15 percent of the total aerofoil height.

Preferably, the gutter is between 5 and 10 percent of the total aerofoil height.

Preferably, the gutter is 6 percent of the total aerofoil height.

Preferably, the gutter overhangs the aerofoil pressure surface from a point located at between 30 and 70 percent aerofoil chord to the trailing edge.

Preferably, the gutter overhangs the aerofoil pressure surface from a point located at about 50 percent aerofoil chord to the trailing edge.

Preferably, adjacent the trailing edge of the aerofoil, between 70 to 90 percent of the gutter width extends beyond the aerofoil pressure surface.

Preferably, adjacent the trailing edge of the aerofoil, between 75 to 85 percent of the gutter width extends beyond the aerofoil pressure surface.

Preferably, adjacent the trailing edge of the aerofoil, 80 percent of the width of the gutter extends beyond the aerofoil pressure surface of the aerofoil.

In an embodiment of the invention the rotor blade is in particular a turbine blade for a gas turbine engine.

The invention will now be described more fully with reference to the accompanying drawings in which.

Figure 1:
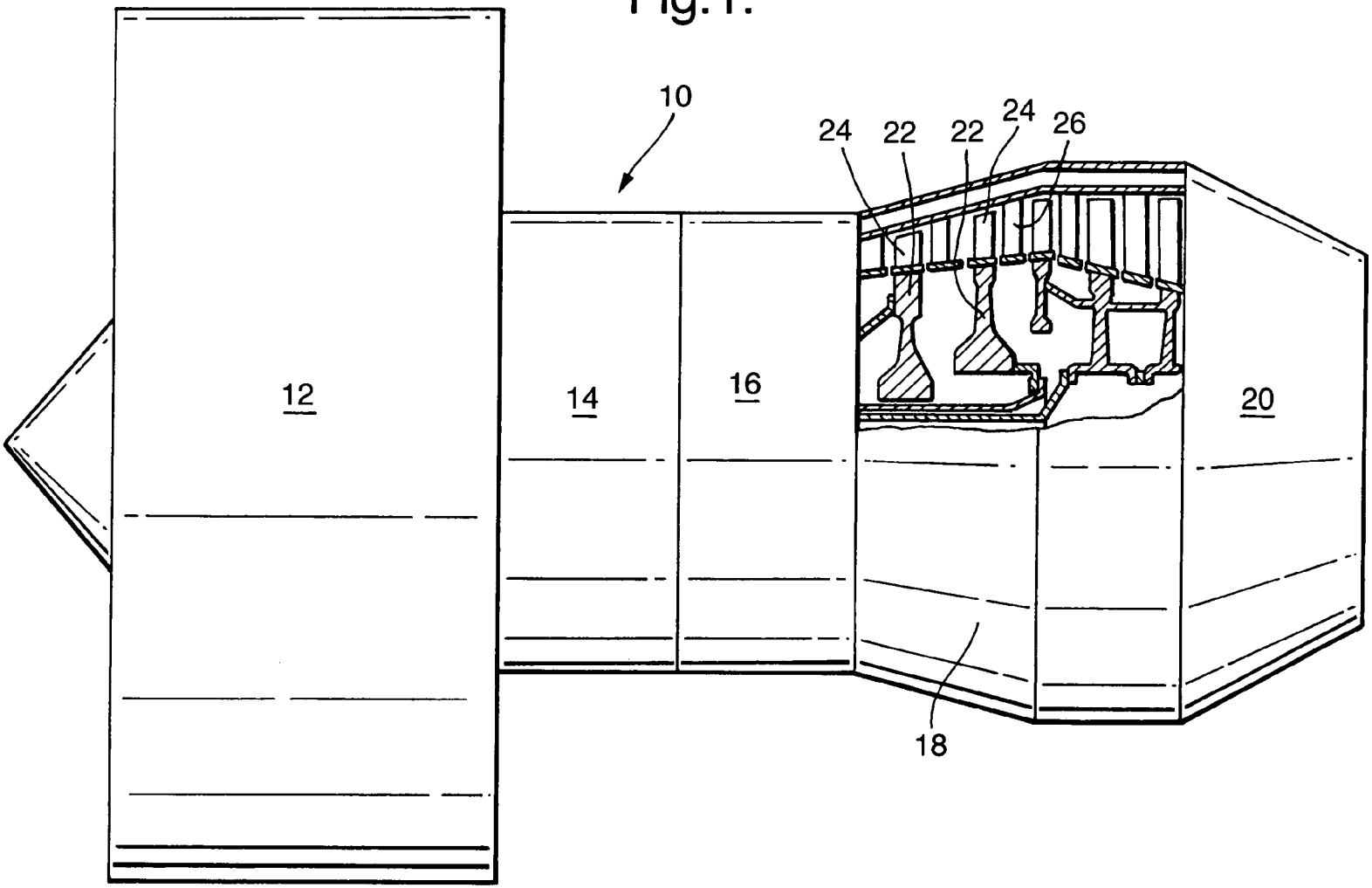
FIG. 1 is a diagrammatic view of a gas turbine engine which is partially cut away to show the turbine section.

A gas turbine engine 10 as shown in FIG. 1 comprises in flow series a fan 12, a compressor 14, a combustion system 16, a turbine section 18, and a nozzle 20. The turbine section 18 comprises a number of rotors 22 and stator vanes 26, each rotor 22 has a number of unshrouded turbine blades 24 which extend radially therefrom.

Figure 2:
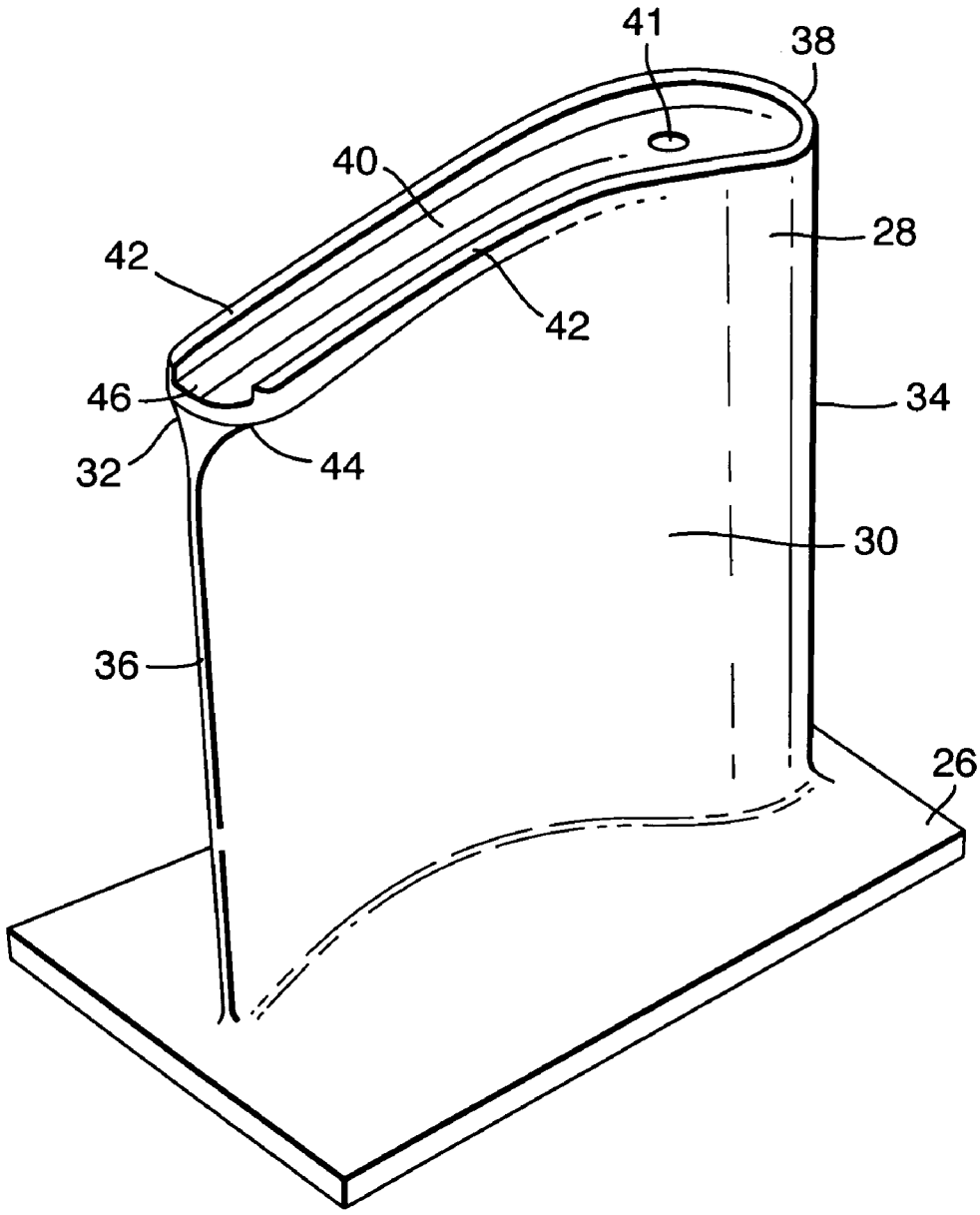
FIG. 2 shows a perspective view from aft of a turbine blade according to the present invention.

FIG. 2 shows a perspective view from aft of an unshrouded turbine blade 24. The blade 24 comprises a platform 26 to from which projects an aerofoil 28. The aerofoil 28 comprises a pressure surface 30 and a suction surface 32 (not visible), which meet at a leading edge 34 and at a trailing edge 36. The aerofoil 28 terminates at a blade tip 38, which is provided with a gutter 40. The gutter 40 comprises an open channel formed by a peripheral wall 42 which is open to the rear, adjacent the trailing edge 36 of the blade 24. The gutter 40 extends slightly aft of the blade trailing edge 36. Typically, the blade 24 is hollow and receives cooling air to this cavity (not shown) which exits the blade via core exit passage and dust holes 41.

At the front of the blade 24, the gutter 40 is of similar cross-section to the aerofoil section 28. However, from a point located about halfway along the chord of the blade 24, the gutter 'flares' so that it becomes progressively wider than the blade 24 in the direction of the trailing edge 36. In the present example, the blade 24 has a radiussed trailing edge 36 with a thickness of about 1 mm. The gutter 40 in this region is about 2 mm wide, the majority of the extra width being accommodated by an overhang 44 located on the pressure surface 30 side of the aerofoil 28. The overhang 44 increases in size towards the trailing edge 36 of the blade 24 such that the gutter 40 in this region is of a constant section. The gutter 40 is provided with an exit aperture 46 adjacent the trailing edge 36 of the blade.

Figure 3:
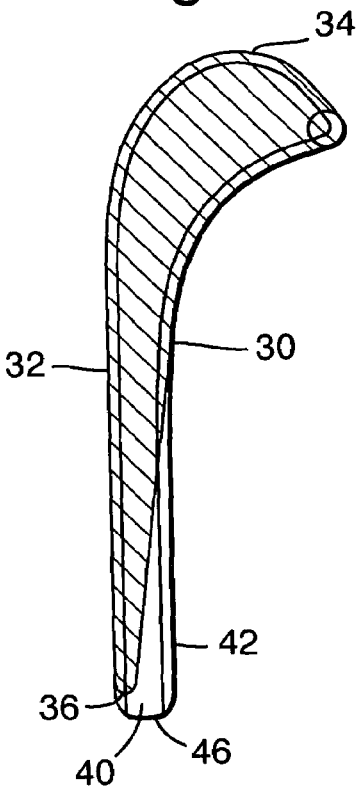
FIG. 3 is a top view of the aerofoil portion of a rotor blade showing the walled portion.
Figure 4:
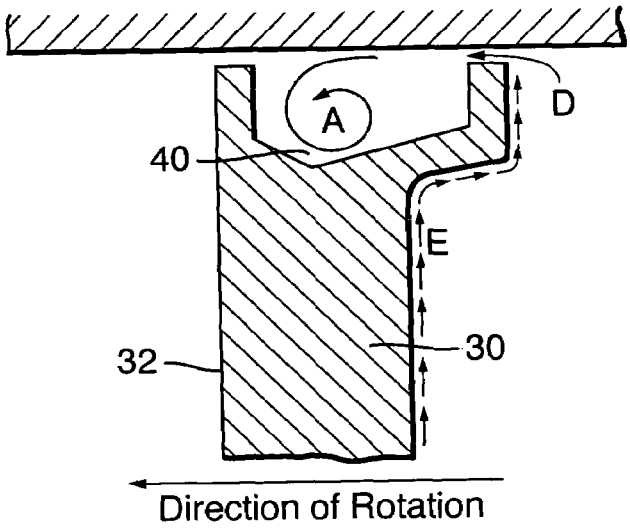
FIG. 4 is a section through the tip of an aerofoil portion indicated by II of FIG. 3 incorporating the gutter.

The shape of the gutter will be better understood if reference is now made to FIG. 3 which shows a plan view, on the gutter, of the blade 24 shown in FIG. 2. The aerofoil section 28, is shaded in order to illustrate the extent of the gutter overhang 44 adjacent the pressure surface 30, in the vicinity of the trailing edge 36.

In operation air enters the gas turbine engine 10 and flows through and is compressed by the fan 12 and the compressor 14. Fuel is burnt with the compressed air in the combustion system 16 and hot gases produced by combustion of the fuel and the air flow through the turbine section 18 and the nozzle 20 to atmosphere. The hot gases drives the turbines which in turn drive the fan 12 and compressors 14 via shafts.

The turbine section 18 comprises stator vanes 26 and rotor blades 24 arranged alternately, each stator vane 26 directs the hot gases onto the aerofoil 28 of the rotor blade 24 at an optimum angle. Each rotor blade 24 takes kinetic energy from the hot gases as they flow through the turbine section 18 in order to drive the fan 12 and the compressor 14.

The efficiency with which the rotor blades 24 take kinetic energy from hot gases determines the efficiency of the turbine and this is partially dependent upon the leakage flow of hot gases between tip 34 of the aerofoil 30 and the turbine casing 48.

The leakage flow across the tip 38 of the blade 24 is trapped within the passage formed by the gutter 40 positioned over the aerofoil tip 38. In the embodiment as indicated in FIG. 3 this trapped flow forms a vortex A within the gutter 40. The flow is then redirected along the passage subsequently exhausting from the gutter trailing edge through the exit aperture 46. In this embodiment the exit aperture 46 comprises an area or width large enough to allow all the flow that occurs between the casing 48 and the pressure side wall 44 of the gutter to exit downstream. Since the area of the exit aperture 46 is of a size sufficient to allow all the tip leakage flow (D) pass through it (as a vortex A) this reduces the risk of some tip leakage flow continuing to exit over the suction side wall 50 of the gutter 40 into the main passage, as is the case for a rotor with a plain rotor tip.

Figure 5:
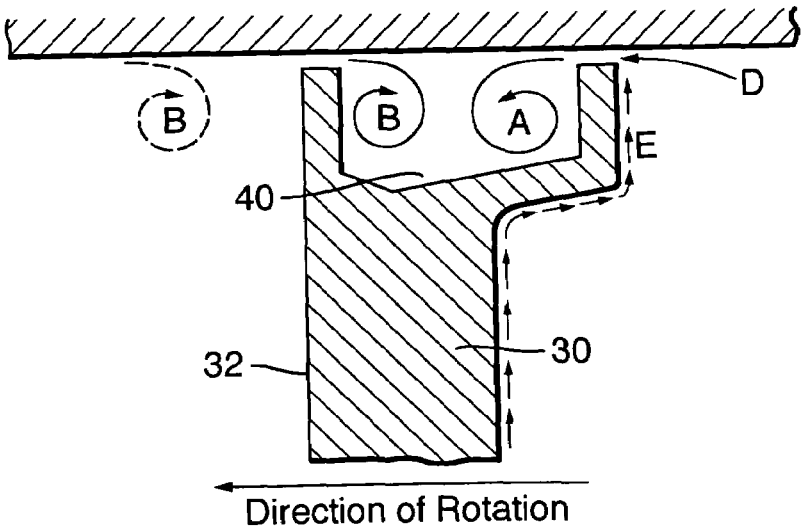
FIG. 5 is another section through the tip of the aerofoil section of FIG. 3 indicated by II.

In another embodiment as illustrated in FIG. 5 the overtip leakage flow D again forms a vortex A within the gutter 40. However in this embodiment the gutter 40 is large enough such that the passage vortex B also forms in the gutter itself. The passage vortex B is formed from the casing boundary layer flow which, in this embodiment, passes between the casing 48 and the pressure side wall 50 of the gutter 40. The area of the exit aperture is of a width sufficient to allow both vortex flows A and B to pass through it. Thus, again, in this embodiment the exit aperture is of a size sufficient to allow both flows A and B to pass through it.

The target velocity distribution of the flow in close proximity to the gutter 40 is for the flow to accelerate continuously to the trailing edge on both the pressure and suction surface sides and thus obtain the peak Mach number (minimum static pressure) at the trailing edge. The aim is for the static pressure in the gutter 40 to match that on the external suction surface 38 of the aerofoil, this will help prevent flow trapped within the gutter from flowing over the sides of the gutter.

A vortex may form within the passage formed by the gutter 40. However the vortex may be weaker than that formed if the overtip leakage flow had been allowed to penetrate the main flow. Interaction of the vortex formed within the gutter 40 will be prevented until the flow is exhausted from the gutter trailing edge.

The flow D along the gutter 40 is established near the leading edge 32 and flows to the trailing edge 34. The flow already established in the gutter may act to reduce flow over the peripheral wall 44, nearer to the trailing edge 34 i.e. act as an ever increasing cross-flow to later leakage flow. Thus the gutter 40 is as effective near the trailing edge as it is further upstream.

A benefit of the gutter 40 being offset towards the aerofoil pressure surface 30 is that any migration of the boundary layer from the pressure surface 30 towards the suction surface 32 (E), i.e. from a region of high pressure to a region of lower pressure, is hindered by the torturous route that the airflow must take around the offset gutter 40. The benefit from having the offset on the pressure surface 30 is greater than a similar offset were on the suction surface 32. Hence the aerodynamic benefit of a flared gutter 40 is obtained while weight at the blade tip 38 is minimised.

In addition to gathering the over tip leakage flow D and some of the boundary layer E, the gutter 40 provides a more efficient exhaust route via the gutter exitaperture 46 for the spent aerofoil cooling air coming, from the core exit passage and dust holes 41, which exits into the gutter 40.

Another advantage of having the gutter 40 offset towards the pressure surface 30 of the blade is that the aerofoil aerodynamics are less sensitive to the increased obstruction at this position than on the suction surface 32.

The invention claimed is:

1. An unshrouded rotor blade, comprising an aerofoil, said aerofoil having a leading edge, a trailing edge, a pressure surface and a suction surface, there being provided at a radially outer extremity of the aerofoil a gutter which is wider than the aerofoil adjacent the trailing edge thereof, wherein at least a part of the gutter is offset toward the aerofoil pressure surface, wherein the gutter predominantly overhangs the aerofoil pressure surface.

2. An unshrouded blade as claimed in claim 1, wherein the gutter overhangs only the aerofoil pressure surface.

3. An unshrouded blade as claimed in claim 1, wherein the gutter overhangs the aerofoil pressure surface adjacent the aerofoil trailing edge.

4. An unshrouded blade as claimed in claim 1, wherein the gutter is between 1 percent and 15 percent of the total aerofoil height.

5. An unshrouded blade as claimed in claim 4, wherein the gutter is between 5 percent and 10 percent of the total aerofoil height.

6. An unshrouded blade as claimed in claim 5, wherein the gutter is 6 percent of the total aerofoil height.

7. An unshrouded blade as claimed in claim 1, wherein the gutter overhangs the aerofoil pressure surface from a point located at between 30 percent and 70 percent aerofoil chord to the trailing edge.

8. An unshrouded blade as claimed in claim 7, wherein the gutter overhangs the aerofoil pressure surface from a point located at about 50 percent aerofoil chord to the trailing edge.

9. An unshrouded blade as claimed in claim 1, wherein, adjacent the trailing edge of the aerofoil between 70 percent to 90 percent of the gutter width extends beyond the aerofoil pressure surface.

10. An unshrouded blade as claimed in claim 9, wherein, adjacent the trailing edge of the aerofoil, between 75 percent to 85 percent of the gutter width extends beyond the aerofoil pressure surface.

11. An unshrouded blade as claimed in claim 10, wherein, adjacent the trailing edge of the aerofoil, 80 percent of the width of the gutter extends beyond the aerofoil pressure surface.

* * * * *